United States Patent [19]

Paverman

[11] 3,973,408

[45] Aug. 10, 1976

[54] CONSTRUCTION OF UNDERGROUND DAMS AND EQUIPMENT THEREFOR

[76] Inventor: Grisha H. Paverman, 200 E. 64th St., New York, N.Y. 10021

[22] Filed: Apr. 7, 1975

[21] Appl. No.: 565,682

[52] U.S. Cl. ..... 61/35; 61/53.64; 61/53.74; 61/58; 52/729; 173/49

[51] Int. Cl.[2] ..... E02D 5/20; E02D 7/18

[58] Field of Search ..... 61/35, 58, 59, 60, 61, 61/62, 53.64, 53.74, 53; 175/19, 56; 173/49; 52/729

[56] References Cited

UNITED STATES PATENTS

| | | | |
|---|---|---|---|
| 2,071,865 | 2/1937 | Parsons | 52/729 X |
| 3,477,237 | 11/1969 | Orkney | 175/19 X |
| 3,852,971 | 12/1974 | Phares | 61/53.74 X |
| 3,865,501 | 2/1975 | Kniep | 175/56 |

FOREIGN PATENTS OR APPLICATIONS

| | | | |
|---|---|---|---|
| 2,550 | 7/1874 | United Kingdom | 52/729 |
| 1,116,381 | 6/1968 | United Kingdom | 61/41 A |

*Primary Examiner*—Jacob Shapiro
*Attorney, Agent, or Firm*—Kirschstein, Kirschstein, Ottinger & Frank

[57] ABSTRACT

A method and equipment for constructing a fluid-impervious underground wall by vertically sinking an elongated web member into the ground where the wall is to be created, the sinking being performed with the aid of vertical vibration of the web member at a frequency that loosens the structure of the soil. The web member thereafter is vertically withdrawn while being vibrated vertically at the same or a higher frequency. As the web member is being sunk, liquid grout is introduced under pressure beneath the downwardly moving lower edge of the web member, such grout being forced into the surrounding soil structure by the tamping effect of said vibrating lower edge. Thereafter, as the web member is withdrawn, more liquid grout is introduced under pressure beneath the now upwardly moving lower edge of the web member so as to fill the space formed by such withdrawal with the grout which is further tamped by the vibrating lower edge to aid in soil penetration, all the grout subsequently setting to form a thick fluid-impervious underground wall segment. The liquid grout penetrates to a substantial extent the soil structure transversely of the plane of the space formed by sinking and withdrawal of the web member so as to form a wall segment which is considerably thicker than the thickness of the web member. The operation is repeated in an overlapping relationship to the previously emplaced grout before the previously emplaced grout has set, until the entire length of the zone to be occupied by the wall has been covered. This invention is an improvement over the method disclosed in U.S. Pat. No. 3,245,222 issued Apr. 12, 1966.

5 Claims, 11 Drawing Figures

20
22
24
26
28
30
32
34
36
38
40
42
44
46
48
50
52
4

CONSTRUCTION OF UNDERGROUND DAMS AND EQUIPMENT THEREFOR

BACKGROUND OF THE INVENTION

1. Field of the Invention

Method of and equipment for forming an underground fluid-impervious wall by the setting of a liquid material introduced into a vibratorily formed space.

2. Description of the Prior Art

U.S. Pat. No. 3,245,222 discloses a process for constructing an underground dam wherein a trench is formed in soil by hammering a group of aligned elongated solid web members into and, thereafter, successively withdrawing the members, one by one, from the soil while concurrently forcing into the space vacated by the withdrawal of member after member, and as the web members are withdrawn, a liquid grout which sets in the space to form a wall. This method, although widely used, was subject to the drawback that hammering of the web members into the ground caused the soil on both sides of the space thus formed to be compacted. This inhibited penetration of the grout transversely into the soil and resulted in the formation of an underground wall the thickness of which was little, if any, more than the thickness of the web members. Moreover, because the web members were hammered into the ground, there was a tendency to hammer them to the same depth so that their bottoms did not follow the shape of the underlying liquid-impervious layer unless that layer was solid rock; the impacting force was so great that they could be and were driven into and even through underlying liquid-impervious substrates.

In another process, a group of such web members were, for the same purpose, vibratorily driven into the ground and, thereafter, successively vibratorily extracted one after another while liquid grout was introduced into the space being vacated, but the vibrations were not of a frequency such as to encourage an appreciable loosening of the soil structure, so that walls formed heretofore by vibratory driving and extraction were not much thicker than the thickness of the wall members themselves. Moreover in such earlier process no liquid grout was injected under the lower edge of the web members to penetrate the soil during sinking.

SUMMARY OF THE INVENTION

1. Purposes of the Invention

It is an object of this invention to provide a method for forming underground dams wherein a single imperforate web member is vibratorily sunk vertically into the ground and then withdrawn, liquid grout being introduced under pressure during both sinking and withdrawal of the web member so that the grout penetrates a substantial distance into the soil at right angles to the plane of the web whereby to substantially increase the thickness of the wall over the thickness of the web member by a factor of as much as about 500%.

It is another object of the invention to provide a method of the character described wherein the frequency of vertical vibrations during sinking approximates the natural frequency of the soil in the vicinity of the lower edge of the web member whereby to maximize the loosening of the soil structure and thus enhance transverse penetration of the liquid grout and wherein the frequency of vertical vibrations during extraction is greater than during sinking whereby to encourage further transverse penetration of the liquid grout.

It is another object of the invention to provide a method of the character described wherein a single web member is sunk and withdrawn and the ensuing space grouted before the web member alongside and in line with the grout-filled space is sunk into the ground and extracted.

It is another object of the invention to provide a method of the character described wherein the web member as it is successively sunk is overlapped with the previously grout-filled space.

It is another object of the invention to provide a method of the character described wherein the bottom edge of the successively sink member follows the shape of the underlying impervious layer.

It is another object of the invention to provide equipment for carrying out the foregoing method.

Other objects of the invention in part will be obvious and in part will be pointed out hereinafter.

2. Brief Description of the Invention

A process for constructing a fluid-impervious underground wall in which an elongated solid member is sunk into the soil at the site where the wall is to be constructed. The sinking is performed vertically and vibratorily, which is to say, with the use of a vibratory driver, this being a device which includes a clamp that is attached to the upper edge of the web member and has fixed thereto a mechanism for imparting vibratory reciprocal vertical forces to the web member. The driver also includes a heavy member or, with the clamp, is sufficiently heavy so that as the web member is vertically reciprocated it will sink into the ground.

Desirably the frequency of the vibratory driver can be varied by the operator. Preferably a vibratory frequency is selected for the vertical vibrations imparted to the web member during sinking which frequency approximates the natural frequency of the soil in the vicinity of the lower edge of the web member so as to maximize loosening of the soil structure. The frequency is readily selected by varying the operating frequency of the driver and selecting the frequency at which the rate of sinking is greatest. This is usually between about 700 and about 1500 cycles per minute. The frequency selected can be changed as different soil structures are encountered during sinking. The moment of the vibratory forces is sufficient for rapid driving and extraction of the web member, typical moments being 20, 40, 60 and 80 kg. m.i.

As the web member is vibratorily sunk into the soil, a liquid grout is continuously injected under pressure beneath the downwardly moving lower edge of the web member, said grout being forced into the surrounding loosened soil structure by the tamping effect of said vibrating lower edge. Such penetration of the liquid grout is substantial since by suitable selection of the vibratory frequency the soil has been loosened for a considerable distance transversely from the lower edge of the web member. It should be noted, however that the invention functions, albeit not to its best degree, where the frequency of vibrations imparted to the web member does not closely match the natural frequency of the soil immediately beneath the web member.

As the web member is withdrawn, more liquid grout is injected under pressure beneath the now upwardly moving lower edge of the web member, so as to fill the space formed by such withdrawal with the grout which is further tamped by the vibrating lower edge to aid in soil penetration, all the grout subsequently setting to form a thick fluid-impervious underground wall segment the thickness of which substantially exceeds the thickness of the web member by as much as five times. The frequency at which the web member is vibrated during extraction preferably, if the vibratory frequency of the driver is adjustable, is somewhat higher, e.g., 200 to 300 cpm, than the sinking frequency since this has been found to increase transverse penetration of the liquid grout into the surrounding soil structure. The extent of the thickness of the wall will depend upon the constitution of the soil into which the web member is sunk. The preferred soils with which the process is used are granular silts, sands and gravels. Compact cohesive soils such as glacial tills and soils including cobbles and boulders are not considered desirable in conjunction with the practice of the invention. A typical grout is a colloidal mixture of clay, e.g., bentonite, Portland cement and water.

To form a practical underground wall a single web member is successively sunk into the soil in alignment with the grout-filled space left by the previous sinking and extraction so that a series of grout-filled spaces is formed in a continuous line where the wall is to be constructed. A fresh web member may be substituted from time to time if the web member becomes deformed or mutilated or if a different cross-sectional configuration of wall segment of segments is desired. The positions in which the web member is successively sunk overlap one another to insure continuity of the set grout wall. Because the wall usually is of considerable height — 80 ft. not being unusual — and because the web member must be longer than the desired height, the web member selected is of such configuration as to provide longitudinal reinforcement against bending away from the plane of the web member, a typical web member being of I-shaped configuration, U-shaped configuration or sinous (corrugated) configuration in a plane perpendicular to its length.

Although the vibratory forces imparted to the web member during sinking and extraction are vertical and in the plane of the web, under the conditions of operation, vibratory forces of like frequency perpendicular to the plane of the web are developed which vibratory forces do not, as one might expect, compact the structure of the soil but, rather, loosen the soil structure to achieve the desired effect of creating grout-permeable voids through which the liquid grout when introduced under pressure and with the aid of tamping can enter into the surrounding soil structure to bring about the formation of a wall of set grout that is considerably thicker than the void left by the web of the web member as it is being extracted. Because the web members are sunk vibratorily, rather than impacted, their penetration ceases upon encountering an underlying impervious layer so that the pattern of the bottom edge of the member follows the shape of said layer.

The invention consists in the elements of construction, combinations of parts and series of steps which will be exemplified in the method and equipment hereinafter described and of which the scope of application will be indicated in the appended claims.

BRIEF DESCRIPTION OF THE DRAWINGS

In the accompanying drawings in which are shown various possible embodiments of the invention.

PREFERRED EMBODIMENTS OF THE INVENTION

Figures 1, 2, 3, 4, 5, 6:
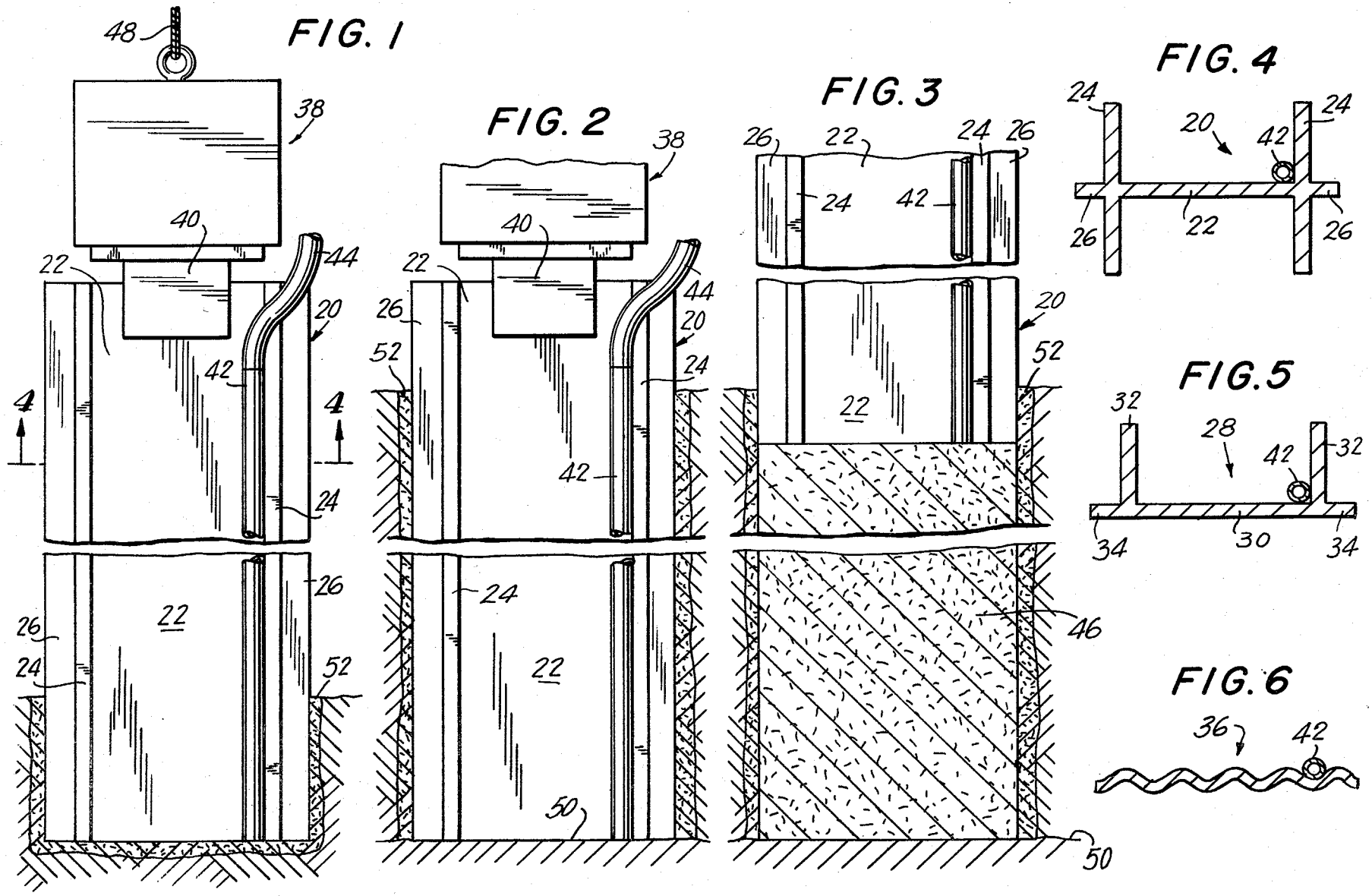
FIG. 1 is a vertical section parallel to and adjacent the plane of a web member as it is being vibratorily sunk into the ground with concurrent injection of grout under its lower edge.
FIG. 2 is a view similar to FIG. 1 showing the web member sunk to a desired depth into the ground.
FIG. 3 is a view similar to FIG. 1 showing the web member during its extraction from the ground and the concurrent injection of grout under pressure into the void left by the withdrawing web member.
FIG. 4 is an enlarged cross-sectional view through the web member, the same being taken substantially along the line 4—4 of FIG. 1, the cross-section of the web member as therein shown being exemplificative of one suitable such cross-section.
FIG. 5 is a view similar to FIG. 4, but showing another cross-section of web member.
FIG. 6 is a view similar to FIG. 4, but showing still another cross-section of web member.

Referring now in detail to the drawings, and more particularly to FIGS. 1–4, 7, 8 and 11, the reference numeral 20 denotes an elongated solid web member which is to be sunk vibratorily vertically into the ground at the location where a subterranean fluid-impervious wall is to be formed. The length of the web member is slightly more than the height of the wall to be formed. A typical length may be as much as 100 ft. The soil with which the present process is used should be such that a web member can vibratorily vertically sunk. Typical such soils are granular silt, sand and gravel. Very compact cohesive soils such as glacial till or soil including cobbles and boulders may cause problems depending on the sites and placements of the cobbles and boulders and on the density of any clay or the like that may be present in the soil structure.

The web member 20 illustrated is of I-shaped cross-section and has a central web 22 with right-angled flanges 24 running along its opposite longitudinal edges, the flanges being parallel to one another. The flanges reinforce the rather long web member against bending perpendicularly to its length. A typical thickness of web is about 1 inch to 1½ inches, 1 inch being the thickness most commonly used.

Desirably, for insuring of continuity of the subterranean wall, the web member has elongated spurs 26 that are continuations of the opposite longitudinal edges of the central web 22 beyond the flanges. The spurs run the full length of the web member, although they may stop short of the upper end by an amount that will protrude from the ground when the web member is sunk to the maximum extent of which it is capable.

Alternate acceptable cross-sections of web member are illustrated in FIGS. 5 and 6. The web member 28 shown in FIG. 5 is channel-shaped and includes a central web 30 and the longitudinal right-angled flanges 32 which, unlike the flange 24 of the web member 20 that extend beyond both faces of the central web member, extend only in the same direction beyond one face of the central web 30. The web member 28 includes spurs 34.

A web member 36 of another acceptable configuration is illustrated in FIG. 6, this web member being of sinusoidal, i.e., corrugated, configuration.

Desirably, when a given shape of web member is used to start the construction of a specific subterranean fluid-impervious wall, the same web member is used to construct the remainder of the wall if it remains in physically good shape. If it becomes malformed to the point where it is not usable it must be replaced or repaired. If a different cross-section is desired for a portion of the wall, a wall member of different cross-section is used.

To sink the web member there is employed a vibratory driver generally denoted by the reference numeral 38. The specific construction of the vibratory driver forms no part of the present invention. Exemplificative drivers are those shown in U.S. Pat. Nos. 3,368,632; 3,394,766; 3,433,311 and 3,564,932.

Generally speaking, these drivers include a pair or more than one pair of oppositely rotating eccentric weights that turn about horizontal axis with the centers of mass of the weights in a common vertical plane that is coextensive with the vertical plane of the central web of the web member. Such a driver will engender vibratory forces in the aforesaid plane and, when fixed to a web member with the plane coextensive with the plane of the central web, will engender vibratory forces in said plane of the central web. The vibratory forces are sinusoidal in nature, that is to say, they peak in a vertical direction upwardly and downwardly successively, the transverse forces of each pair of counter-rotating weights nullifying one another. The axes of rotation of the sundry weights are horizontal when the driver is fixed to a vertical web member. The counter-weights are turned by a suitable motor which may be electrical or hydraulic and which is not shown inasmuch as said drivers including power units for turning the weights are well known in the art.

Desirably the frequency of the vibratory driver can be varied by the operator. A suitable available range is from about 700 to about 1500 cycles per minute. Each cycle includes one upwardly directed force and one downwardly directed force. The moments of the vibratory forces depend upon the frequency of vibrations and upon the soil into which the web member is being sunk, typical moments used being from 20 to 80 kg. m.i. The selected frequency of vibrations depend upon the particular soil into which the web member is being sunk. Preferably the frequency selected during sinking approximates the natural frequency of the soil in the vicinity of the lower edge of the web member; this maximizes the loosening of the soil structure. Such matching of frequency coincides with the fastest rate of sinking of the web member which is readily visually ascertainable. Desirably the selected frequency of vibration is changed as different soil structures are encountered during sinking, the operator varying the frequency when he observes that the rate of sinking slows down. The vibratory frequency for extractions desirably is somewhat higher than sinking, e.g., 200 to 300 cpm higher. Such matching of frequency, although most helpful in efficient practice of the invention, is not essential.

The vibratory driver includes a clamp 40 such, for example, as shown in U.S. Pat. Nos. 3,368,632 and 3,391,435.

Essentially, the clamp comprises a pair of opposed members each designed to engage one of the two opposite faces of the central web adjacent the top end thereof as illustrated in FIG. 1. The two members are moved toward and away from each other by any suitable means, typically by a hydraulic piston-cylinder arrangement.

The web member has associated therewith a grout injection pipe 42, the same being securely and rigidly attached thereto, for example by welding. The pipe is located in a position with respect to the cross-section of the web member where it will be minimally damaged during the sinking operation, a typical location being in the corner between any flang and the central web. The pipe is open at the top where it is connected as by a flexible conduit 44 to a source of liquid grout (not shown) under pressure. The bottom of the pipe is adjacent the lower edge of the web member, preferably not being below the same unless the bottom end is protected or reinforced so that it will not be deformed as the web member is sunk.

The grout constitutes a liquid mixture of a material which, when allowed to set, will harden. The usual grout mixture includes a combination of clay, cement and sand. This will insure good mechanical strength and sufficient flexibility for the set wall to remain undamaged by deformation. The grout is pumped into the injection pipe at a suitable period of the wall-forming cycle by a high pressure displacement pump. Typically, the pressure of the grout varies from about 1 to 10 atmospheres gauge. The grout may omit sand, if desired. It is prepared in bulk in a mixer (a colloidal high-speed mixer, not shown) which through its shearing actions breaks up the individual clay and cement particles to produce a fluid grout. From the mixer, in a typical installation, the grout goes to a slow-speed agitating retention tank from which the high-pressure displacement pump forces it through the injection pipe when called for.

The bottom end of the injection pipe is open.

The start of a cycle for sinking and extracting a web member is illustrated in FIG. 1. First, the web member is gripped adjacent its upper edge by the clamp 40. Then the driver is lifted as by a crane which is attached to the driver by a cable 48. The crane is manipulated to raise the web member up in the air so that it assumes a vertical position under its own weight. Then the web member is guided to the point where the subterranean wall is to be started or, if desired, to any point along the wall. The web member is turned so that the central web lies on the line along which the wall is to run. Thereafter, the crane is lowered sufficiently for the bottom edge of the web member to touch the ground where the web member is to be sunk. Next, the driver 38 is actuated to induce vertical vibratory forces in the web member. The crane, thereupon, is gradually lowered so that the full weight of the driver and clamp is applied to the top edge of the web member. Usually, this full weight is sufficient to cause the web to sink into the ground. The sinking takes place due to the reduction of frictional forces between the web member and the soil caused by the vertical vibratory forces. If the weight of the web member and clamp is not sufficient due to the nature of the soil, additional weight is added to the driver. However, no impaction or hammering takes place. Essentially, the web member sinks under its own weight, the weight of the driver and the clamp and any additional weight that may be attached to the driver. If the frequency rate of the driver is variable, a frequency is selected as indicated above.

As the web member sinks into the ground, its bottom edge continues to go lower and lower until, finally, as shown in FIG. 2, the bottom edge of the web member being vibratorily sunk reaches a relatively impervious layer 50 which may be an extremely cohesive clay or a rock stratum. At this point the web member will not sink any further so that downward movement of its bottom edge stops.

Previous determination has been made of where this substrate is situated and a length of web member is chosen bearing in mind the depth to which the web member must sink to reach the substrate. The web members usually come in standard sizes. The length of the web member selected will be a size sufficient for the web member to reach the impervious substrate and still have a portion thereof extend above the ground.

The full sinking of the web member is illustrated in FIG. 2 in which the bottom edge of the web member is illustrated as having reached the underlying impervious substrate 50. At this time, of course, the driver and clamp still will be above ground, unless for some reason a trench has been dug at the surface of the ground, in which case, the clamp and/or part or all of the driver may enter the trench.

During the sinking of the web member, the liquid grout is forced into the pipe and out the bottom end thereof where it forms a liquid pad, i.e., layer or cushion, beneath the downwardly moving lower edge of the web member. The injection pressure, assisted by the tamping effect of said vibrating lower edge causes such grout to penetrate the structure of the surrounding soil as indicated at 52. The illustrated extent of penetration is not to scale, simply being diagrammatic. Moreover, the grout acts as a lubricant to further ease sinking of the web member into the soil so that lesser vibratory force is needed to obtain a given speed of sinking and, hence, a smaller and less expensive driver and driver motor can be employed.

After the vibratory vertical sinking of the web member has been completed, that is to say, after said web member has reached the impervious substrate 50, the driver is slowly pulled upwardly by the crane an cable 48 so as to gradually extract the same while being vertically vibrated and leave behind it a vertical space in the configurationof the web member, the space gradually enlarging vertically as the web member is extracted. Vibratory extraction of the web member does not require a great effort commensurate, for example, to the effort which would be required if no vertical vibrations were being engendered by the driver during extraction. This reduced effort is due to the vertical vibratory forces which reduce the friction that otherwise would exist as a static friction between the surface of the web member and the surrounding soil. The vibration rate during extraction is higher than during sinking, if possible, for the reason previously given.

It is pointed out that as the web member is vertically sunk into the ground under its own weight and that of the driver and clamp and possibly an additional weight, and as the web member is being vibratorily extracted, the vibrations induced in a vertical plane by the driver in the web member induce secondary transverse vibrations, that is to say, vibrations transverse to the vertical plane of the web member which vibrations cause the surrounding soil to vibrate, as a result of which there is caused a substantial loosening of the soil to the extent that voids are created around the web member and flanges and stubs.

These voids are filled with the grout during sinking of the web member, the flow of the grout into the same being due to the pressure under which the grout is injected and to the tamping effect of the vibrating lower edge of the web member. Indeed, the pressurized grout, which itself is vibrating by forces transmitted therethrough from te vibrating web member, itself further loosens the soil structure to develop additional voids that immediately are filled by the grout. As the web member is vibratorily extracted with continued injection of grout under pressure the grout fills the gradually enlarging space under the bottom edge of the withdrawing web member. At the same time the grout penetrates further into the soil surrounding the space left by the withdrawing web member due to the combined effect of the pressure of the grout, the vibration of the soil directly caused by the vibrating web member and the vibration of the soil caused by the vibrations of the grout itself. It has been found that the grout penetrates into the surrounding space to a very substantial extent, in the order of about five times the thickness of the central web.

The penetration of the grout into the surrounding soil takes place in a transverse plane.

The injection of the grout is stopped when the bottom edge of the web member being withdrawn clears the surface of the ground.

Eventually, the grout will set to form an impervious wall segment which, in conjunction with all of the remaining wall segments that as soon will be pointed out, are overlapping, will constitute a fluid-impervious subterranean wall. However, before the grout in a given segment, in this instance the first segment, sets, the extracted web member, or another web member substituted for the same, if desired, is sunk into the ground in alignment with the grout-filled space left by the first-sunk and extracted web member. By "alignment" it is meant that the central web of the web member, as it is sunk in the next succeeding site, is in line with the position previously occupied by the said central web or substantially in line therewith, for example, if the wall is to be of curved contour. Generally speaking, walls of the type under consideration are substantially straight when viewed from the top. However, this is not always the case. Upon occasion, a subterranean wall may include portions at an angle to one another and, in this event, the web member will lie along the corresponding desired angular leg of the wall. However, successive segments of the wall invariably will overlap. This is particularly desirable because if two consecutive segments of the wall formed in the manner aforesaid do not overlap, the wall no longer will be fluid-impervious. Even if the degree of non-contiguity of the spaces formed by the sunk and extracted web member is slight, so that an eventual contiguity results because of the penetration of the grout as aforementioned, the wall will not be as strong as desired in the area of non-contiguity, so it is particularly desirable that overlapping, at least to some extent, exists.

Figures 7, 8, 9, 10, 11:
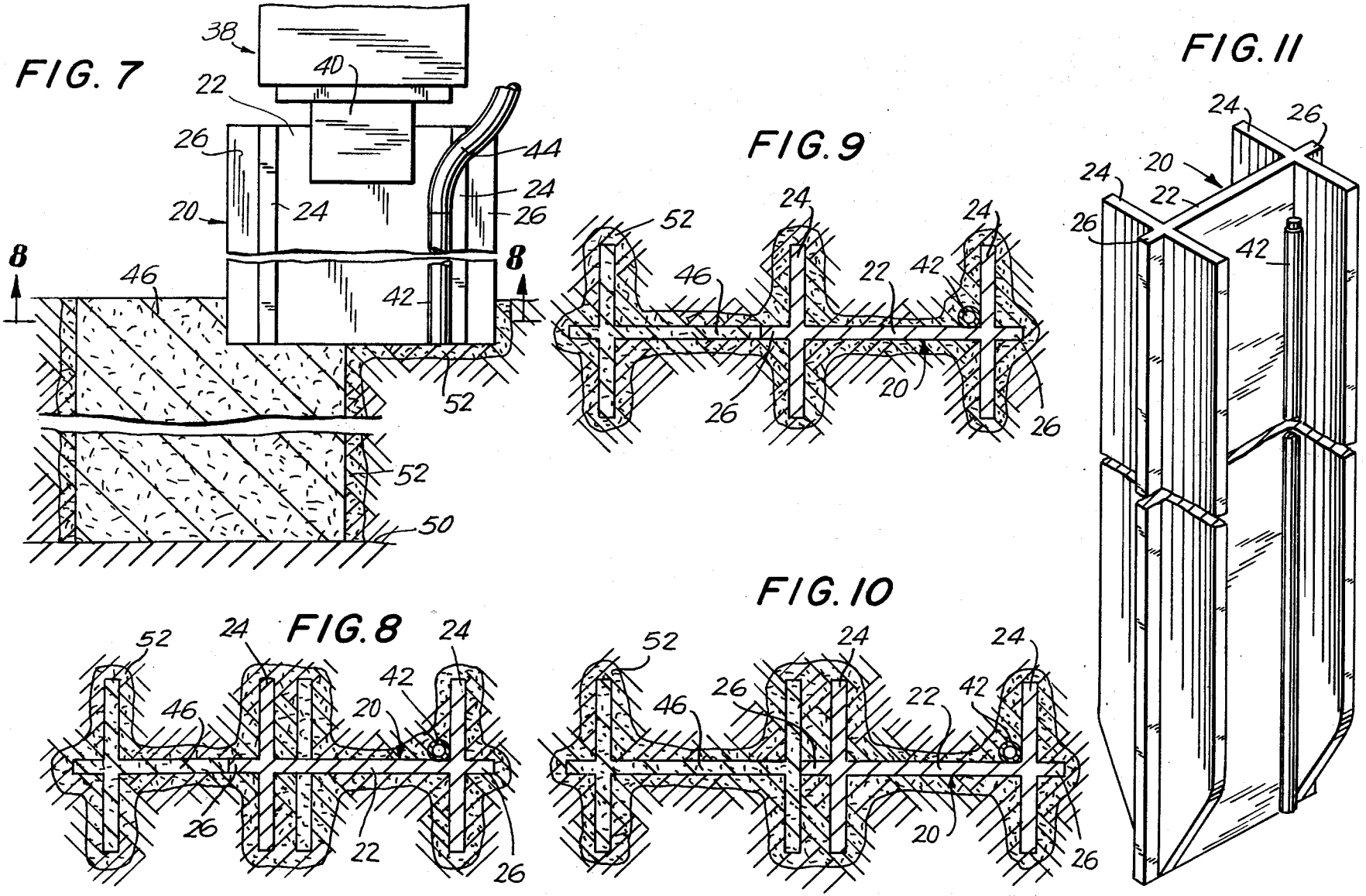
FIG. 7 is a view similar to FIG. 1, but showing the sinking of a second web member in alignment with and slightly overlapping the space lift by extraction of the first web member which space was filled with grout prior to the illustrated second sinking of the web member.
FIG. 8 is an enlarged cross-sectional view taken substantially along the line 8—8 of FIG. 7 and illustrating the overlap between the grout-filled space formed by the first sunk web member and the position occupied by the second sinking of the web member.
FIG. 9 is a view similar to FIG. 8, but showing a different extent of overlapping.
FIG. 10 is another view similar to FIG. 8, but showing still a different extent of overlapping.
FIG. 11 is an enlarged fragmentary perspective view of an I-shaped web member on which there can be seen the conduit for introducing grout under pressure under the lower edge of the web member as it is being sunk into and extracted from the ground.

In FIG. 7 there is shown the beginning of the subsequent sinking of the web member 20 alongside the grout-filled space left by previously sinking and extracting the web member. It will be observed that the web member 20, as it is vibratorily vertically sunk for the second time and, hence, for succeding times — although these succeeding times are not illustrated because it would be unnecessarily duplicative — has an edge portion thereof overlapping an edge portion of the grout-filled space left by previously sinking and extracting the web member. The amount of overlapping may vary. different degrees of overlap are shown in FIGS. 8, 9 and 10 for the web member 20.

In FIG. 8 the overlap is the greatest of the three overlaps shown, in FIG. 10 the overlap is the least of the three overlaps shown, and in FIG. 9 the overlap is intermediate the overlaps illustrated in FIGS. 8 and 10.

In FIG. 8 the overlap is such that the spur 26 of the web member 20, as it is sunk for the second time, encroaches upon a portion of the space left upon withdrawal of the web member when first sunk and withdrawn. The portion it encroaches upon is the grout-filled space left by extraction of the central web 22, and specifically a part of the space between the grout-filled space left by sinking and withdrawing of the flanges 24, said portion being closer to the grout-filled space lift by the flange 24 which is nearer to the position occupied by the web member as it is sunk for the second time. As will be seen in FIG. 8 the grout-filled space left by the flange 24 of the web member sunk for the first time is spaced from the flange 24 of the web member being sunk for the second time, the space being in a direction toward the grout-filled space left by the other flange of the web member when sunk for the first time.

In FIG. 9 the location of the web member 20 sunk for the second time is such that the flange 24 of the web member being sunk for the second time substantially coincides with the nearby grout-filled space left by a flange of the web member sunk for the first time.

In FIG. 10 the only overlap is that of the spur 26 into the grout-filled space left by a spur 26 of the web member sunk and extracted for the first time.

The amount of overlapping is specified by the engineering staff who designed the subterranean wall and, in general, will be larger with looser soils and lesser with more cohesive soils.

In FIGS. 8, 9 and 10 the transverse penetration 52 of the grout is schematically illustrated and, from these figures, readily appreciated; that is to say, it will be understood how by virtue of such transverse penetration the subterranean wall finally formed is much thicker than would be expected and than would be if the grout simply filled only the space left by extraction of the web member.

It is, as indicated above, most desirable to sink any succeeding web member before the grout sets in the space left by the previously sunk and extracted web member. If this necessitates continuous day and night operation because the grout sets rapidly, this desirably is effected. However, the setting of the grout can be slowed down by incorporating therein the usual setting inhibitors for grout. It will be appreciated, of course, that when the grout penetrates the interstices of the soil, the particles of the soil, in effect, become intermixed with the grout so that the set grout and soil jointly function as a solid set mass of material. Indeed, in many instances it is desirable to omit the sand from the grout because it not only makes the grout less viscous but the sand of the soil takes the place of the sand usually used as a part of a set concrete.

After the second cntiguous segment of the wall has been formed in the manner aforesaid, further successive segments are made until the wall is completed.

It will be appreciated that because the web members are sunk vibratorily and their bottom edges stop at the underlying impervious substrate, the bottom edge of the succession of the segments thus formed will have a contour that follows the contour of the impervious underlying substrate. Likewise, the successive positions of the top edge of the web member will follow the same contour although this will not be noticeable inasmuch as only one web member at a time is sunk.

It also should be mentioned that because of the reinforcing elements used in the web member, to wit, the flanges of the web members 20 and 28 and the corrugations of the web member 36, the web member as it is sunk into the soil does not tend to drift sidewise. Also, it does not tend to drift perpendicularly to the central web. Hence, as the web member is sunk in successive overlapping positions, any tendency for discontinuities in successive grout-filled spaces is substantially inhibited.

It thus will be seen that there are provided a method and equipment which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A method of constructing a fluid impervious subterranean wall which comprises vertically sinking a web member into the ground by applying to the web member a vertically vibratory force, then extracting the web member from the ground while applying a vertically vibratory force thereto, concurrently injecting under pressure into the ground beneath the lower edge of the web member as it is sunk and extracted a liquid settable grout, the vibratory sinking and extraction of the web member loosening the soil surrounding the space occupied by the web member as it is sunk and extracted, and the grout filling the space left by the web member as it is being extracted and also during sinking and extraction filling voids vibratorily developed in the ground surrounding such space so as to substantially transversely enlarge the grout-filled volume at and around the vibratorily sunk and withdrawn web member beyond the aforesaid space, and thereafter successively sinking and extracting said web member in the ground alongside the grout-filled space left by the preceeding sunk and extracted web member, and in overlapping relationship thereto, and while injecting grout under pressure beneath the lower edge of the web member, before the grout in the previously grout-filled space has set.

2. A method as set forth in claim 1 wherein the frequency of vibrations is from about 700 to about 1500 cycles per minute.

3. A method as set forth in claim 1 wherein the web member includes a central web, longitudinal flanges at the longitudinal edges of the central web and at least one elongated spur at at least one longitudinal edge of the central web, the base of the spur being located at the associated flange, said spur extending outwardly away from the associated flange and being coplanar with the central web, and the overlapping is such that a flange on the web member being sunk is disposed between the grout-filled spaces left by the flanges on the web member last extracted.

4. A method as set forth in claim 1 wherein the web member includes a central web, longitudinal flanges at the longitudinal edges of the central web and at least one elongated spur at at least one longitudinal edge of the central web, the base of the spur being located at the associated flange, said spur extending outwardly away from the associated flange and being coplanar with the central web, and the overlapping is such that a flange on the web member being sunk is disposed substantially in the adjacent grout-filled space left by a flange on the web member last extracted.

5. A method as set forth in claim 1 wherein the web member includes a central web, longitudinal flanges at the longitudinal edges of the central web and at least one elongated spur at at least one longitudinal edge of the central web, the base of the spur being located at the associated flange, said spur extending outwardly away from the associated flange and being coplanar with the central web, and the overlapping is such that a spur on the web member being sunk is disposed at least partially within the adjacent grout-filled space left by the nearer spur on the web member last extracted.

* * * * *